US010190342B2

(12) United States Patent
Rudraraju et al.

(10) Patent No.: US 10,190,342 B2
(45) Date of Patent: Jan. 29, 2019

(54) DOOR LOCK MECHANISM FOR VEHICLE

(71) Applicants: HYUNDAI MOTOR INDIA ENGINEERING Pvt. Ltd., Hyderabad (IN); Hyundai Motor Company, Seoul (KR); KIA MOTORS CORP., Seoul (KR)

(72) Inventors: Ch. P. K. N. Varma Rudraraju, Hyderabad (IN); Youn Seob Kim, Uiwang-si (KR)

(73) Assignees: HYUNDAI MOTOR INDIA ENGINEERING Pvt. Ltd., Hyderabad (IN); Hyundai Motor Company, Seoul (KR); KIA MOTORS CORP., Seoul (KR)

( * ) Notice: Subject to any disclaimer, the term of this patent is extended or adjusted under 35 U.S.C. 154(b) by 1125 days.

(21) Appl. No.: 14/494,370

(22) Filed: Sep. 23, 2014

(65) Prior Publication Data

US 2016/0069106 A1 Mar. 10, 2016

(30) Foreign Application Priority Data

Sep. 5, 2014 (IN) ..... 4371/CHE/2014

(51) Int. Cl.

| | |
|---|---|
| ***E05B 85/20*** | (2014.01) |
| ***E05B 77/24*** | (2014.01) |
| ***E05B 79/22*** | (2014.01) |
| ***E05B 81/16*** | (2014.01) |
| ***E05B 85/24*** | (2014.01) |

(Continued)

(52) U.S. Cl.

CPC ..... *E05B 85/20* (2013.01); *E05B 77/24* (2013.01); *E05B 79/22* (2013.01); *E05B 81/16* (2013.01); *E05B 85/243* (2013.01); *E05B 85/12* (2013.01); *E05B 85/18* (2013.01)

(58) Field of Classification Search

CPC ..... E05B 85/20
USPC ..... 292/201, 216, DIG. 23
See application file for complete search history.

(56) References Cited

U.S. PATENT DOCUMENTS 5,653,484 A * 8/1997 Brackmann ..... E05B 77/28 292/216
2004/0036298 A1* 2/2004 Hayakawa ..... E05B 83/36 292/216

FOREIGN PATENT DOCUMENTS

JP 2000-345752 A 12/2000
JP 2009-30362 A 2/2009
JP 2011-111827 A 6/2011

(Continued)

*Primary Examiner* — Kristina R Fulton
*Assistant Examiner* — Thomas L Neubauer
(74) *Attorney, Agent, or Firm* — Morgan, Lewis & Bockius LLP

(57) ABSTRACT

A door lock mechanism for a vehicle, may include a lock pin which is moved between an unlocked position and a locked position in a radial direction from a rotation axis of a pawl lever, wherein at the unlocked position, a rotating displacement of an outside handle lever is configured to be transmitted to the pawl lever, and at the locked position, the rotating displacement of the outside handle lever is configured to not be transmitted to the pawl lever, a lock lever which is selectively rotated to allow the lock pin to be moved in the radial direction, a safety lever engaged with the lock lever, the safety lever receiving a manipulation force of a safety knob and rotating the lock lever, and an interlinking unit which allows a rotating displacement of the pawl lever to be partly transmitted to the safety lever.

4 Claims, 10 Drawing Sheets

(51) Int. Cl.
*E05B 85/12* (2014.01)
*E05B 85/18* (2014.01)

(56) References Cited

FOREIGN PATENT DOCUMENTS

| | | | |
|---|---|---|---|
| KR | 10-0667446 | B1 | 1/2007 |
| KR | 10-0828440 | B1 | 5/2008 |
| KR | 10-2009-0064225 | A | 6/2009 |

* cited by examiner

DOOR LOCK MECHANISM FOR VEHICLE

CROSS-REFERENCE TO RELATED APPLICATION

The present application claims priority of Indian Patent Application Number 4371/CHE/2014, filed on Sep. 5, 2014, the entire contents of which application are incorporated herein for all purposes by this reference.

BACKGROUND OF THE INVENTION

Field of the Invention

The present invention relates, in general, to a door lock mechanism for a vehicle and, more particularly, to a door lock mechanism for a vehicle which has a self-cancel function and an override function.

Description of Related Art

Generally, a door lock mechanism for a vehicle is provided with a door latch and has a safety lock function to prevent the release and lock the door latch. Thus, when locked by actuating a safety knob inside of a vehicle or using a key outside of a door of a vehicle, the door latch cannot be unlocked even by internally or externally manipulating an inside door handle or an outside door handle, thereby rendering the door locked.

However, when a user intends to open a door from the interior of a vehicle, he/she should first unlock the safety knob and then manipulate the inside door handle to unlock the door latch and thus open the door. This process causes the user inconvenience of two-step manipulation, so an override function is often introduced to unlock the door latch and open the door only with the manipulation of the inside door handle.

Further, in order to prevent the case where a door is accidently locked in a state where a car key remains in a vehicle, so the door cannot be opened outside of the vehicle, a self-cancel function is often introduced that, when a door is closed after the door latch is locked using the safety knob in a state of the door being opened, the locked door latch is automatically unlocked.

Here, it is preferred in terms of cost, durability, and operative reliability that the door lock mechanism be provided with such an override function and self-cancel function without a separate active actuator.

The foregoing is intended merely to aid in the understanding of the background of the present invention, and is not intended to mean that the present invention falls within the purview of the related art that is already known to those skilled in the art.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a door lock mechanism for a vehicle which is provided with an override function and a self-cancel function without a separate active actuator, thereby reducing the manufacturing cost and ensuring durability and operative reliability.

In order to achieve the above object, in one aspect, a door lock mechanism for a vehicle, may include a lock pin which is moved between an unlocked position and a locked position in a radial direction from a rotation axis of a pawl lever, wherein at the unlocked position, a rotating displacement of an outside handle lever is configured to be transmitted to the pawl lever, and at the locked position, the rotating displacement of the outside handle lever is configured to not be transmitted to the pawl lever, a lock lever which is selectively rotated to allow the lock pin to be moved in the radial direction, a safety lever engaged with the lock lever, the safety lever receiving a manipulation force of a safety knob and rotating the lock lever, and an interlinking unit which allows a rotating displacement of the pawl lever to be partly transmitted to the safety lever.

The pawl is elastically supported by a return spring such that the pawl receives the elastic force of the return spring and thus restricts a rotation of a claw, wherein the interlinking unit protrudes from the safety lever towards the pawl lever, such that the rotating displacement of the pawl lever, which is generated in a release direction that is a direction along which the pawl is rotated to allow the rotation of the claw, is transmitted to the safety lever, and wherein the lock lever is rotated along with a rotation of the safety lever by the interlinking unit, to move the lock pin into the unlocked position.

The interlinking unit may include a link lever, a first side of which is rotatably fixed to the safety lever and a second side of which protrudes towards the pawl lever so that, in a returned state where the pawl lever is not subjected to the manipulation force, but is only applied with the elastic force of the return spring, the link lever is separated from the pawl lever.

The pawl lever is provided, on an end side thereof, with a bent part which is bent perpendicularly from a rotating surface of the pawl lever, wherein the link lever is mounted to protrude towards and thus come into contact with the bent part, and wherein an inside handle lever is mounted to, upon rotation, transmit a manipulation force of an inside handle to the pawl lever via the bent part.

The lock pin is formed integrally with a connecting lever which is rotatably connected to the lock lever, wherein an outside handle lever is provided with a lock pin guide along which the lock pin is linearly guided in the radial direction, and wherein the pawl lever is provided with an accommodating groove, which is configured such that, when the lock pin is located at the locked position, the lock pin is configured to be inserted into the accommodating groove without coming into contact with the pawl lever even when the lock pin is rotated by the rotation of the outside handle lever.

The safety lever is mounted above the pawl lever, and the link lever lies, by weight, extending from the safety lever towards the pawl lever.

The pawl lever is rotated in cooperation with a pawl, wherein the pawl restricts or allows a rotation of a claw which may have engaged with a striker by rotation thereof, and wherein the claw engages with and disengages from the striker by rotation thereof.

The door lock mechanism for the vehicle may further include an inside handle lever which receives a manipulation force of an inside handle to rotate the pawl lever to allow the pawl to rotate such that the claw is in a rotatable state, an outside handle lever which is mounted concentrically with the rotation axis of the pawl lever to receive a manipulation force of an outside handle and rotate the pawl lever.

According to an aspect of the present invention, the door lock mechanism for a vehicle is provided with an override function and a self-cancel function without a separate active actuator, thereby reducing the manufacturing cost and ensuring durability and operative reliability.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
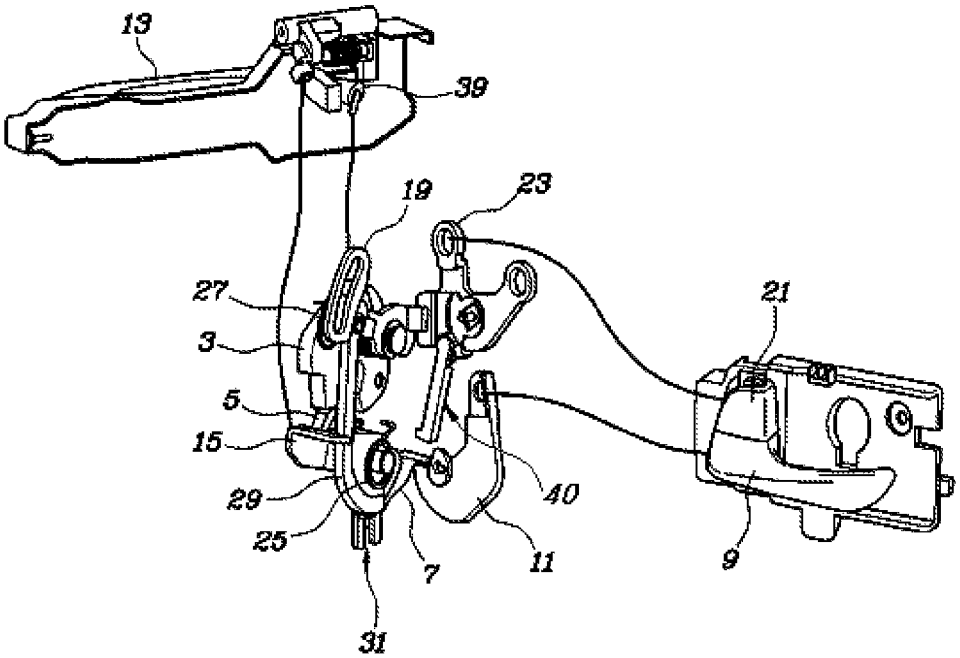
FIG. 1 is a view illustrating the configuration of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinbelow, a preferred embodiment of the present invention will be described in detail with reference to the accompanying drawings.

Referring to FIGS. 1 to 4, a door lock mechanism for a vehicle according to an embodiment of the present invention includes: a claw 3 which engages with and disengages from a striker 1 by rotation, a pawl 5 which restricts or allows the rotation of the claw 3 which has engaged with the striker 1 by rotation, a pawl lever 7 which is rotated in cooperation with the pawl 5, an inside handle lever 11 which receives the manipulation force of an inside handle 9 to rotate the pawl lever 7 to allow the pawl to rotate such that the claw 3 is in a rotatable state, an outside handle lever 15 which is mounted concentrically with a rotation axis of the pawl lever 7 to receive the manipulation force of an outside handle 13 and rotate the pawl lever 7, a lock pin 17 which is moved between an unlocked position and a locked position in a radial direction from the rotation axis of the pawl lever 7, wherein at the unlocked position, the rotating displacement of the outside handle lever 15 is able to be transmitted to the pawl lever 7, whereas at the locked position, the rotating displacement is not able to be transmitted to the pawl lever, a lock lever 19 which is rotated to allow the lock pin 17 to be moved in the radial direction, a safety lever 23 which receives the manipulation force of a safety knob 21 and rotate the lock lever 19, and an interlinking unit 40 which allows the rotating displacement of the pawl lever 7 to be partly transmitted to the safety lever 23.

The pawl 5 is elastically supported by a return spring 25 such that the pawl receives the elastic force of the return spring and thus restricts the rotation of the claw 3, which is elastically supported by a support spring 27 in a direction of being disengaged from the striker 1.

The striker 1 is fixed to a vehicle body, and the claw 3 and the pawl constitute a door latch and are mounted to a door of a vehicle.

Figure 2:
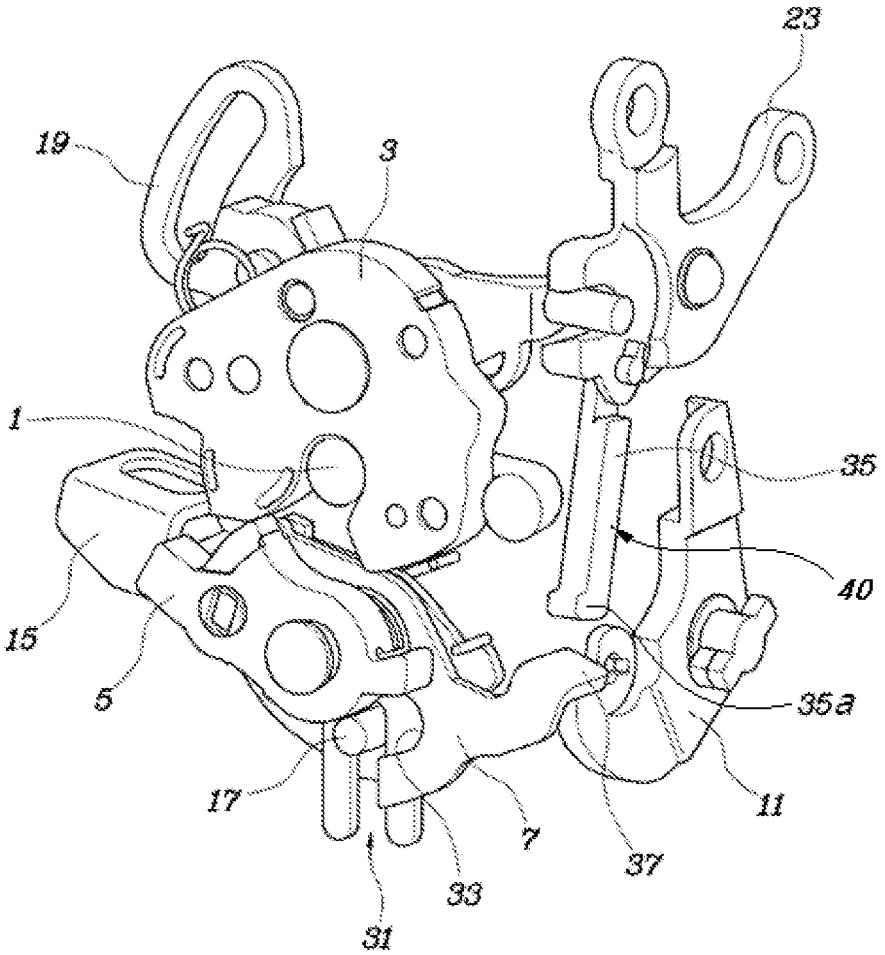
FIG. 2 is a view illustrating major parts of the configuration of FIG. 1 viewed from a different angle, wherein a lock pin is located at a locked position.
Figure 3:
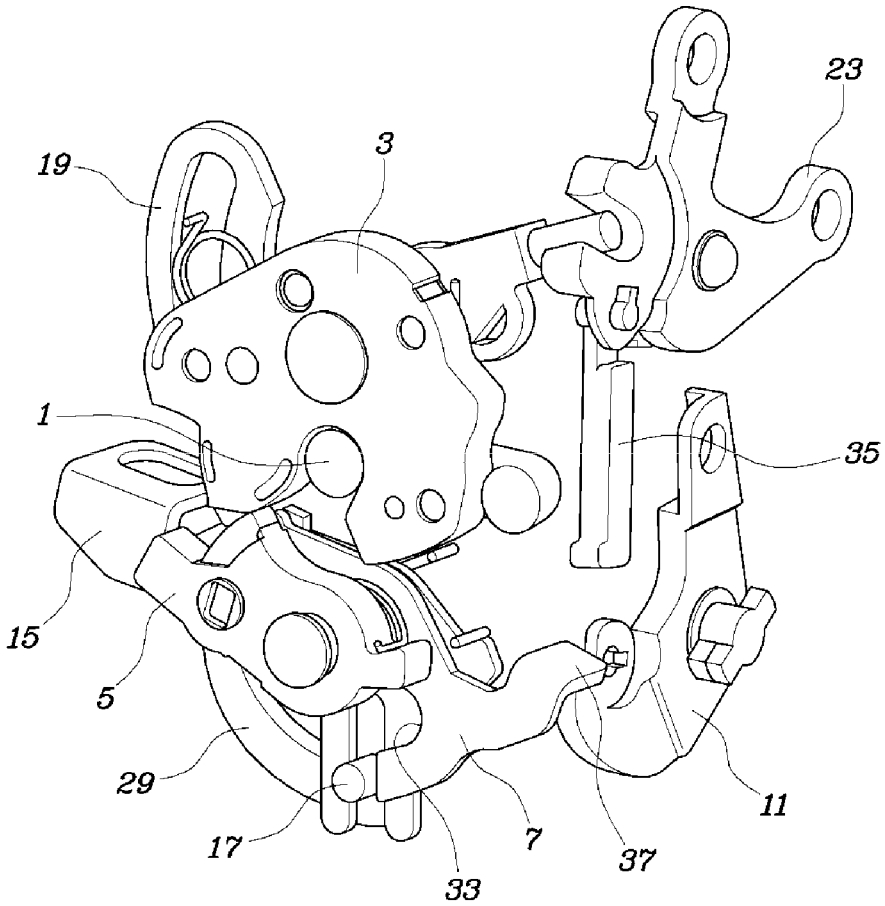
FIG. 3 is a view illustrating the configuration of FIG. 2, wherein, however, the lock pin is located at an unlocked position.

In FIGS. 2 and 3, the claw 3 is engaged with the striker 1, so the door is in a locked state. In contrast, in FIG. 4, the claw 3 is disengaged from the striker 1, so the door is in an unlocked state.

Figure 4:
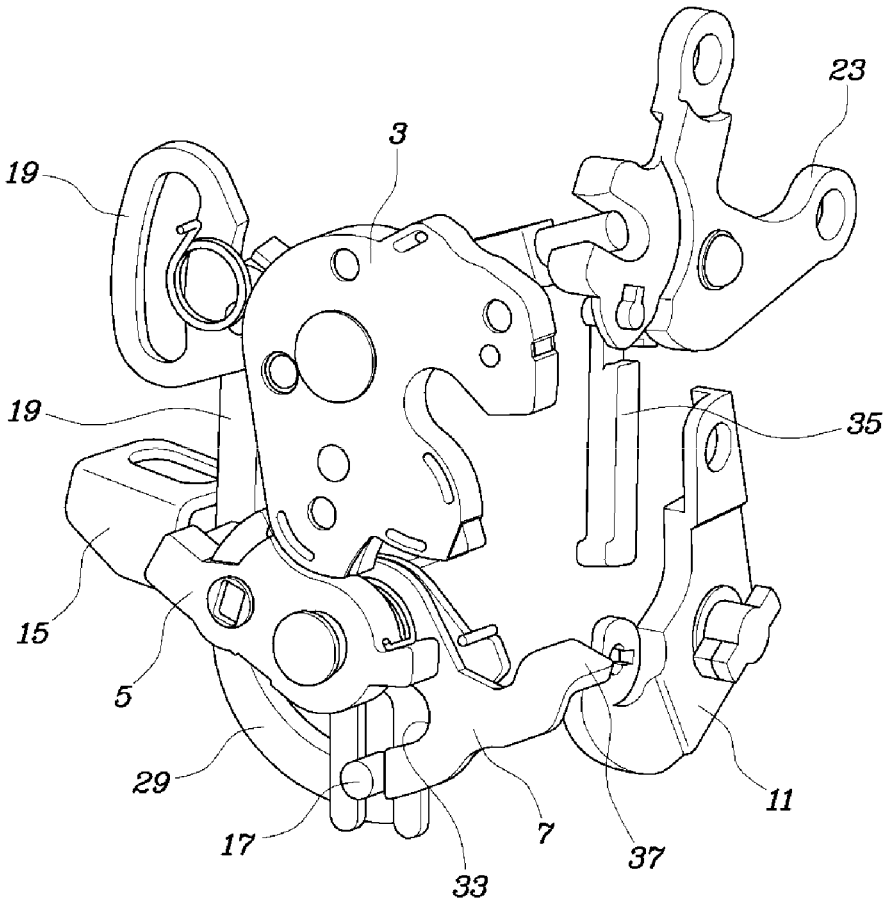
FIG. 4 is a view illustrating the configuration of FIG. 3, wherein, however, a pawl is released in a release direction and then is returned, so that a claw is rotated to disengage from a striker.

In FIGS. 2 and 3, the claw 3 is restricted from being rotated as shown in FIG. 4 by the pawl 5, unless the pawl 5 is rotated counterclockwise. The claw 3 is disengaged from the striker 1 when the pawl 5 is rotated counterclockwise by the pawl lever 7, which is operated by the action of the inside handle lever 11 connected to the inside handle 9 and the outside handle lever 15 connected to the outside handle 13.

For reference, in FIG. 1, the line connecting the inside handle 9 and the inside handle lever 11, the line connecting the safety knob 21 and the safety lever 23, the line connecting the outside handle 13 and the outside handle lever 15, and the line connecting a key lock 39 and the lock lever 19 indicate a conventional cable or rod through which a linear displacement is transmitted.

When the inside handle lever 11 is rotated clockwise in FIG. 3 by the inside handle 9, the pawl lever 7 is rotated counterclockwise together with the pawl 5 to allow the rotation of the claw 3. Then, the claw 3 is rotated by device of the elastic force of the support spring 27 so that the claw is disengaged from the striker 1.

In addition, when the outside handle lever 15 is rotated counterclockwise in FIG. 3 by the outside handle 13, the pawl lever 7 is rotated counterclockwise together with the pawl 5 by the lock pin 17 to allow the rotation of the claw 3. Then, the claw 3 is rotated counterclockwise by device of the elastic force of the support spring 27 so that the claw is disengaged from the striker 1.

The lock pin 17 is formed integrally with a connecting lever 29 which is rotatably connected to the lock lever 19, the outside handle lever 15 is provided with a lock pin guide 31 along which the lock pin 17 is linearly guided in the radial direction, and the pawl lever 7 is provided with an accommodating groove. The accommodating groove is configured such that, when the lock pin 17 is located at the locked position, the lock pin 17 can be inserted into the accommodating groove without coming into contact with the pawl lever 7 even when the lock pin 17 is rotated by the rotation of the outside handle lever 15.

Thus, when the outside handle lever 15 is rotated in a state where the lock pin 17 is located at the unlocked position as shown in FIG. 3, the lock pin 17 allows the pawl lever to be rotated counterclockwise, so that the claw 3 can be disengaged from the striker 1. However, when the lock pin 17 is located at the locked position as shown in FIG. 2, the lock pin 17 is inserted into the accommodating groove 33 so as not to rotate the pawl lever 7 even when the outside handle lever 15 is rotated to rotate the lock pin 17 towards the pawl lever 7, thereby realizing the safety lock function in which the claw 3 maintains the engaged state with the striker 1.

The interlinking unit 40 protrudes from the safety lever 23 towards the pawl lever 7, such that the rotating displacement of the pawl lever 7, which is generated in the release direction (the counterclockwise direction in FIG. 3) that is the direction along which the pawl 5 is rotated to allow the rotation of the claw 3, is transmitted to the safety lever 23. The lock lever 19 is rotated along with the rotation of the safety lever 23 by the interlinking unit, to move the lock pin 17 into the unlocked position.

In the present embodiment, the interlinking unit 40 includes a link lever 35 which is configured such that one side thereof is rotatably fixed to the safety lever 23 and the other side thereof protrudes towards the pawl lever 7 so that, in a returned state where the pawl lever 7 is not subjected to the manipulation force, but is only applied with the elastic force of the return spring 25, the link lever is separated from the pawl lever 7.

For reference, in FIGS. 2 and 3, the pawl lever and the pawl are in a returned state.

The safety lever 23 is mounted above the pawl lever 7, and the link lever 35 lies, by weight, extending from the safety lever 23 towards the pawl lever 7.

The pawl lever 7 is provided, on an end side thereof, with a bent part 37 which is bent perpendicularly from a rotating surface of the pawl lever. The link lever 35 is mounted in such a manner as to protrude towards and thus come into contact with the bent part 37. The inside handle lever 11 is mounted in such a manner as to, upon rotation, transmit the manipulation force of the inside handle 9 to the pawl lever 7 via the bent part 37.

The override function is a function that in a state where the safety lock function, in which the claw 3 is engaged with the striker 1 and at the same time, the lock pin 17 is located at the locked position as shown in FIG. 2, is realized, when the inside handle 9 is manipulated by a user, the lock pin 17 is moved into the unlocked position as shown in FIG. 4, and the claw 3 is disengaged from the striker 1 as well, thereby allowing the door to be opened only with the manipulation of the inside handle 9.

Figure 5:
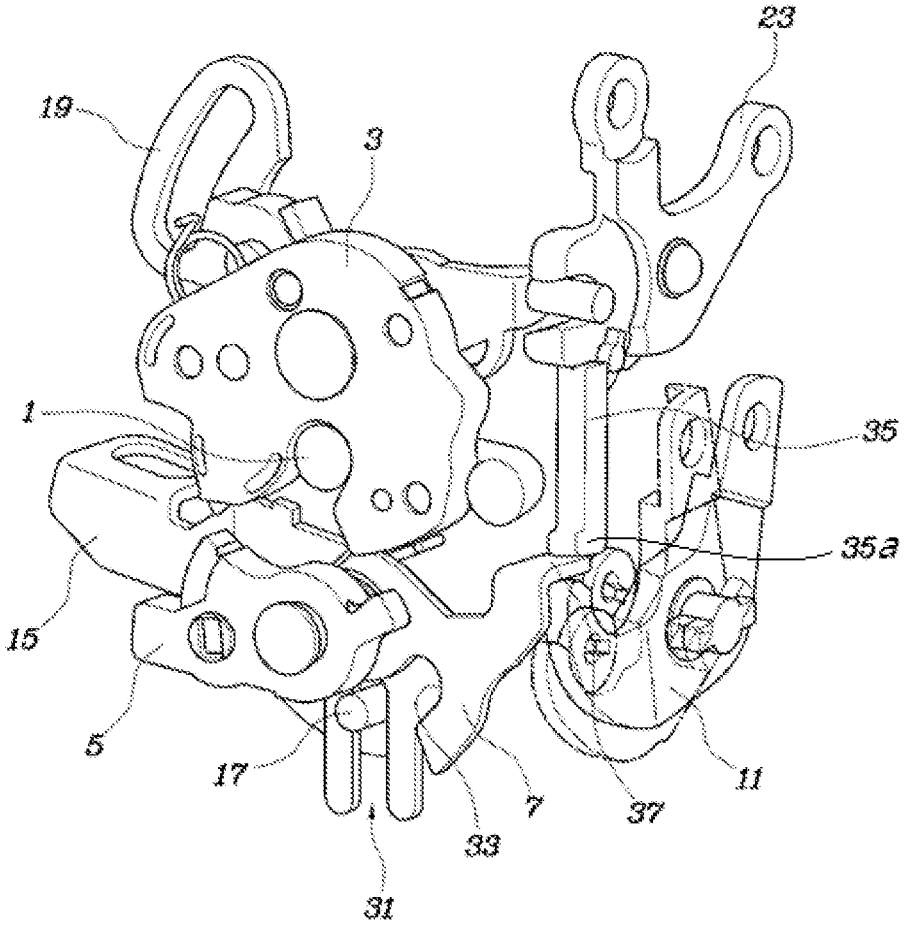
FIG. 5 is a view illustrating an override function which allows switching from the state of FIG. 2 to the state of FIG. 4 with the action of an inside handle lever.

In the present embodiment, the override function can be realized by switching from the state of FIG. 2 to the state of FIG. 4 by the operation shown in FIG. 5.

That is, when the inside handle 9 is manipulated by a user in the state of FIG. 2, as shown in FIG. 5, the inside handle lever 11 is rotated clockwise to rotate the pawl lever 7 counterclockwise, enabling the pawl 5 to allow the rotation of the claw 3. Also, the rotation of the inside handle allows an upper surface of the bent part 37 of the pawl lever 7 to push up a protrusion 35*a* formed at a lower end of the link lever 35, allowing the safety lever 23 to be rotated clockwise. Then, the lock lever 19 connected to the safety lever 23 is rotated counterclockwise to move the connecting lever 29 down, thereby lowering the lock pin 17 integrally formed with the connecting lever 29 into the unlocked position shown in FIG. 4.

Thus, the safety lock can be unlocked and the claw 3 can be disengaged from the striker 1 by a user so that the door can be in an unlocked state, only by manipulating the inside handle 9 without separately operating the safety knob 21.

Figure 6:
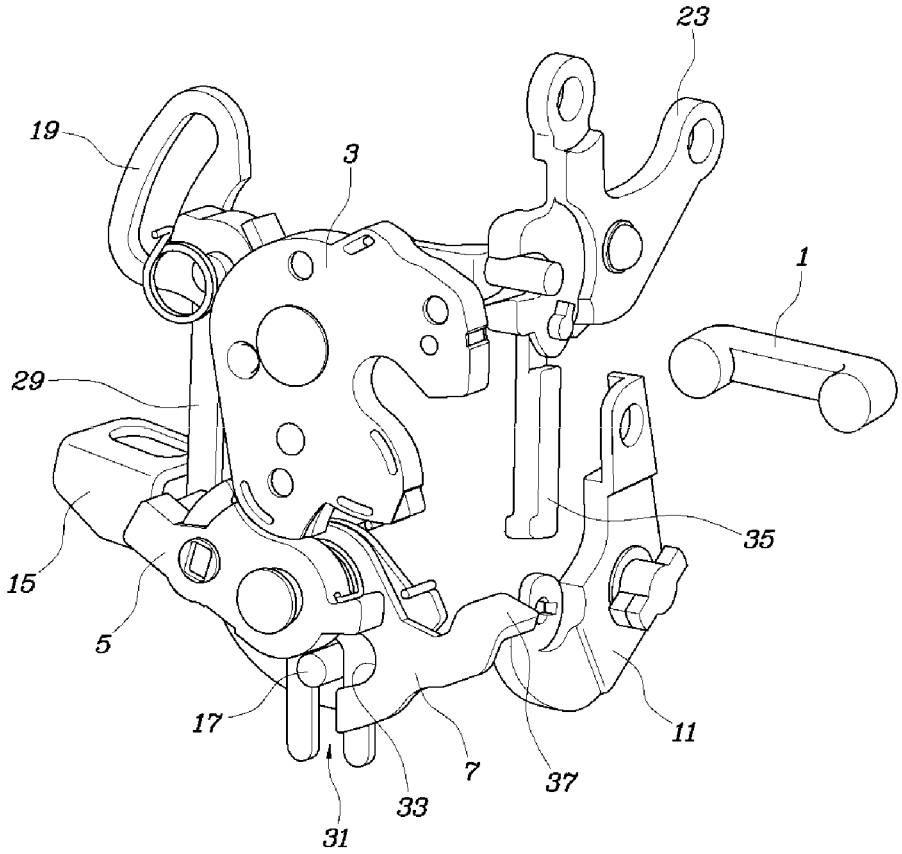
FIG. 6 is a view illustrating a self-cancel function of the configuration according to an exemplary embodiment of the present invention.

FIGS. 6 to 10 show a process of the self-cancel function, wherein FIG. 6 shows the state where in a door-opened state, the safety lock function is realized by the manipulation of the safety knob 21, so that the lock pin 17 is located at the locked position.

Figure 7:
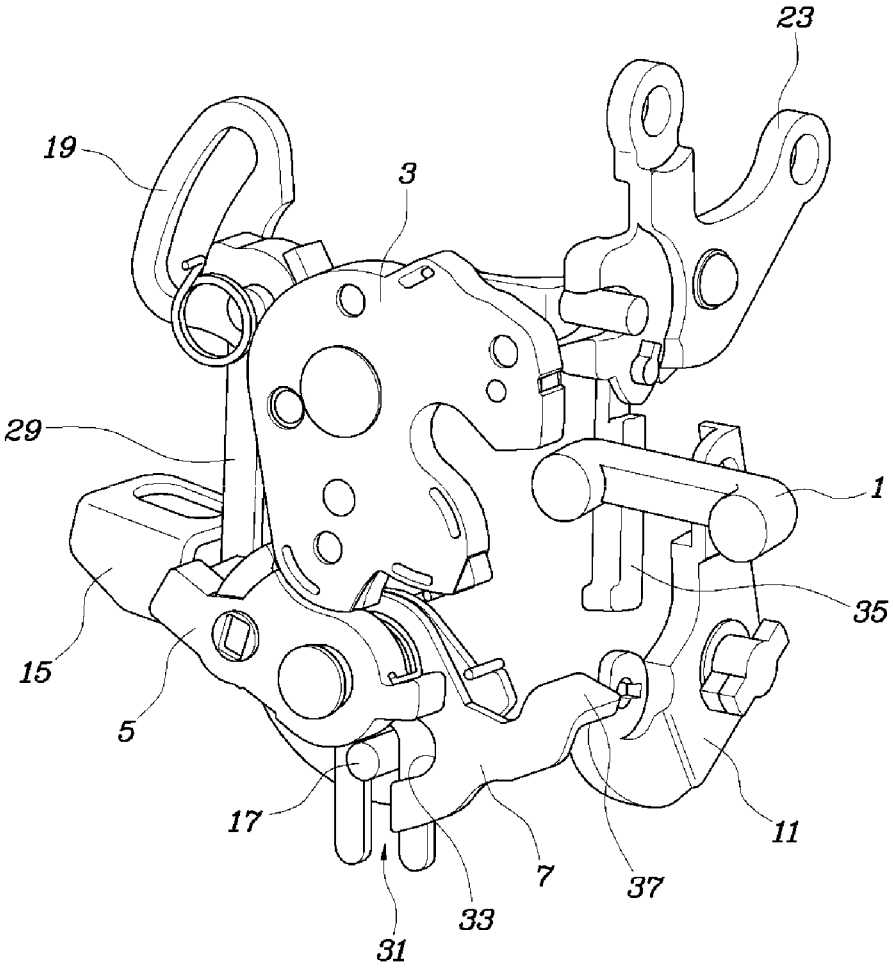
FIG. 7 is a view illustrating a self-cancel function of the configuration according to an exemplary embodiment of the present invention.

When the door is closed at that state, as shown in FIG. 7, the claw 3 is rotated clockwise about and gradually engages with the striker 1, and the pawl 5 is rotated counterclockwise by the rotation of the claw 3.

Figure 8:
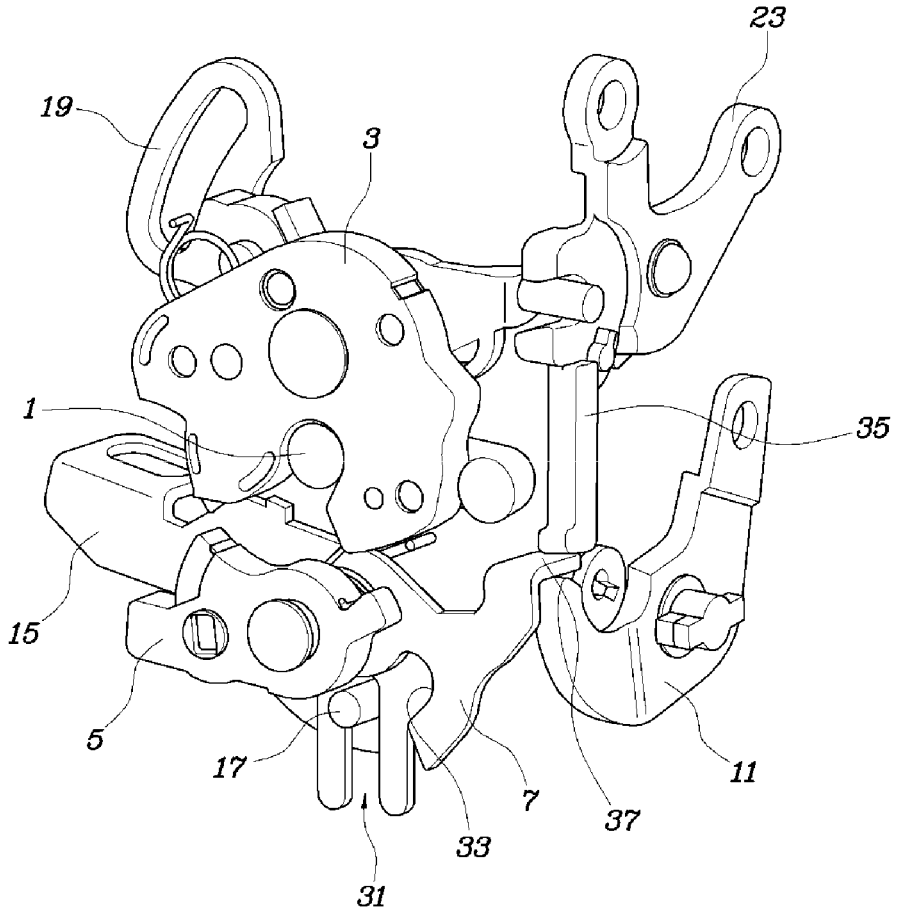
FIG. 8 is a view illustrating a self-cancel function of the configuration according to an exemplary embodiment of the present invention.

As the pawl 5 is rotated counterclockwise, as shown in FIG. 8, the pawl lever 7 is rotated counterclockwise together so that the bent part 37 pushes the link lever 35 upwards, allowing the safety lever 23 to rotate the lock lever 19 counterclockwise.

Figure 9:
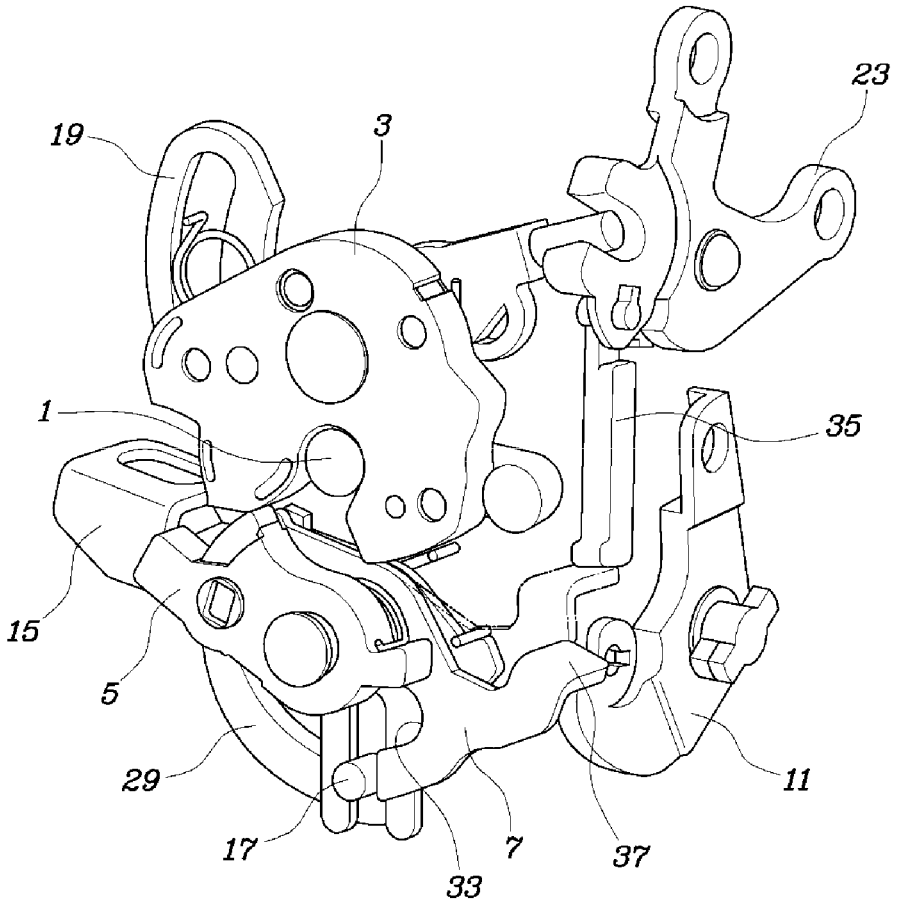
FIG. 9 is a view illustrating a self-cancel function of the configuration according to an exemplary embodiment of the present invention.

FIG. 9 shows the state where, as the lock lever 19 is rotated counterclockwise, the connecting lever 29 is moved down so that the lock pin 17 is moved into the unlocked position, and the pawl 5 and the pawl lever 7 are returned to their initial position by the elastic force of the return spring 25.

Figure 10:
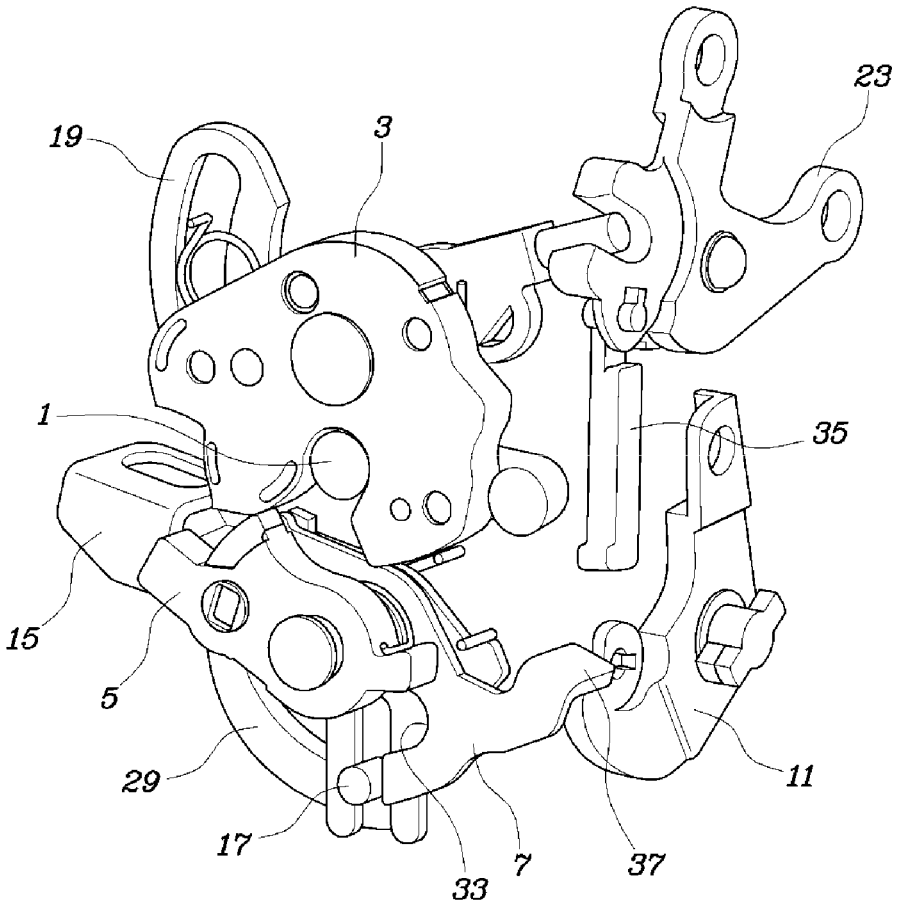
FIG. 10 is a view illustrating a self-cancel function of the configuration according to an exemplary embodiment of the present invention.

FIG. 10 shows the state where the pawl 5 and the pawl lever 7 have been completely returned. That is, the door is closed so that the claw 3 is engaged with the striker 1 in such a manner that the rotation of the claw 3 is prevented by the pawl 5. In this state, the lock pin 17 is located at the unlocked position, so that the door can be opened by disengaging the claw 3 from the striker 1 by the manipulation of the outside handle 13.

That is, before the door is closed, the lock pin 17 is located upwards at the locked position as shown in FIG. 6, whereas, after the door is closed, the lock pin 17 is automatically moved down into the unlocked position shown in FIG. 10 through the intermediate states shown in FIGS. 7 to 9, realizing the self-cancel function. Thus, the claw 3 is disengaged from the striker 1 only with the manipulation of the outside handle, so that, even when the door is closed after the safety lock is realized by the manipulation of the safety knob 21, in a state where a start key is accidently laid in a vehicle, the door can be opened using the outside handle 13 outside of the door.

For reference, the above configuration of the exemplary embodiment may be implemented such that an actuator such as a motor or the like and a controller are connected to the safety lever 23 to allow the configuration to be actively controlled. Since the override function and self-cancel function are automatically realized by a mechanical mechanism as mentioned before, such a further configuration can be eliminated in the present embodiment, so that it is possible to provide a more simple controller.

For convenience in explanation and accurate definition in the appended claims, the terms "upper", "lower", "inner"

and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A door lock mechanism for a vehicle, comprising:

an outside handle lever;

a lock pin which is movable between an unlocked position and a locked position in a radial direction from a rotation axis of a pawl lever rotatable by a rotating displacement of the outside handle lever, wherein at the unlocked position, the rotating displacement of the outside handle lever is transmitted to the pawl lever, and at the locked position, the rotating displacement of the outside handle lever is not transmitted to the pawl lever;

a lock lever which is selectively rotated to allow the lock pin to be moved in the radial direction;

a safety lever engaged with the lock lever, the safety lever receiving a manipulation force of a safety knob and rotating the lock lever; and an interlinking unit which allows a rotating displacement of the pawl lever to be partly transmitted to the safety lever, wherein the interlinking unit comprises: an elongated element, a first end of which is rotatably fixed to the safety lever and a second side of which protrudes towards the pawl lever so that, in a returned state where the pawl lever is not subjected to the manipulation force, but is only applied with an elastic force of a return spring, the elongated element is separated from the pawl lever, and wherein the pawl lever is configured to allow the rotating displacement of the pawl lever to transmit to the safety lever via the elongated element, wherein a pawl which is rotated in cooperation with the pawl lever is elastically supported by the return spring such that the pawl receives the elastic force of the return spring and thus restricts a rotation of a claw, wherein the lock lever is rotated along with a rotation of the safety lever by the interlinking unit, to move the lock pin into the unlocked position, wherein the pawl lever is provided, on an end side thereof, with a bent part which is bent perpendicularly from a rotating surface of the pawl lever, wherein the elongated element is mounted to protrude towards and thus come into contact with the bent part of the pawl lever, wherein an inside handle lever is mounted to, upon rotation, transmit a manipulation force of an inside handle to the pawl lever via the bent part of the pawl lever, wherein the elongated element is provided, on a lower end thereof, with a protrusion which is faced with the bent part such that the protrusion come into direct contact with the bent part of the pawl lever upon rotation of the pawl lever, and the protrusion is integrally formed with the elongated element, wherein the pawl lever is rotated in cooperation with the pawl;

wherein the pawl restricts or allows a rotation of the claw which has engaged with a striker by rotation thereof; and wherein the claw engages with and disengages from the striker by rotation thereof.

2. The door lock mechanism for the vehicle according to claim 1, wherein the lock pin is formed integrally with a connecting lever which is rotatably connected to the lock lever, wherein the outside handle lever is provided with a lock pin guide along which the lock pin is linearly guided in the radial direction, wherein the pawl lever is provided with an accommodating groove, which is configured such that, when the lock pin is located at the locked position, the lock pin is configured to be inserted into the accommodating groove without coming into contact with the pawl lever even when the lock pin is rotated by the rotation of the outside handle lever.

3. The door lock mechanism for the vehicle according to claim 1, wherein the safety lever is mounted above the pawl lever, and the elongated element is extended from the safety lever towards the pawl lever.

4. The door lock mechanism for the vehicle according to claim 1, further comprising:

the inside handle lever which receives a manipulation force of the inside handle to rotate the pawl lever to allow the pawl to rotate such that the claw is in a rotatable state;

wherein the outside handle lever is mounted concentrically with the rotation axis of the pawl lever to receive a manipulation force of an outside handle and rotate the pawl lever.

* * * * *